United States Patent [19]

Meckley

[11] 4,389,032

[45] Jun. 21, 1983

[54] RETRACTABLE WING KITE

[76] Inventor: Charles O. Meckley, 29520 SW. 199th Ave., Homestead, Fla. 33030

[21] Appl. No.: 282,175

[22] Filed: Jul. 10, 1981

[51] Int. Cl.[3] ..... A63H 27/08

[52] U.S. Cl. ..... 244/153 R

[58] Field of Search ..... 244/153 R, 153 A, 154, 244/155 R, 155 A, 152, 38; D21/88, 89, 91; 24/115 R, 130, 129 R

[56] References Cited

U.S. PATENT DOCUMENTS

| | | | |
|---|---|---|---|
| 1,028,409 | 6/1912 | Westerman | 244/38 |
| 1,354,728 | 10/1920 | de Créquy | 244/38 |
| 1,831,247 | 11/1931 | Hitt | 244/201 |
| 2,520,704 | 8/1950 | Wisney | 244/153 R |
| 3,022,966 | 2/1962 | Briggs | 244/154 |
| 3,110,460 | 11/1963 | Koonce et al. | 244/153 R |
| 4,119,283 | 10/1978 | De Yarman | 46/79 |

*Primary Examiner*—Charles E. Frankfort
*Assistant Examiner*—Rodney Corl
*Attorney, Agent, or Firm*—Kathleen H. Claffy

[57] ABSTRACT

A kite made of sheet foam material with a hinged airfoil which is resiliently biassed closed, or flat, and constructed so that it is opened by the wind, the amount of opening depending on the strength of the wind; the preferred embodiment includes a keel where the connection between the keel and the airfoil is made by thrusting rods through holes in the keel and holes are reenforced with a bent stiffening member.

2 Claims, 8 Drawing Figures

RETRACTABLE WING KITE

BACKGROUND OF THE INVENTION

The invention relates to kites and particularly to a kite which can be flown in both light and strong winds and maintains its stability in strong or gusty wind conditions as well as in light wind conditions.

In the past, many devices have been used to increase the stability of kites. The use of a tail is one of the oldest of these devices.

The use of a keel to eliminate the necessity for a tail is also well-known, e.g. U.S. Pat. No. 4,216,929.

Several kites which have vents in the airfoil to increase stability in high winds are known; namely, U.S. Pat. Nos. 3,110,460 3,796,399, and 4,099,690. The only one of these which provides any variability to the vent is U.S. Pat. No. 3,796,399. This patent uses a complex structure to provide a small degree of wind-controlled variability.

As far as is known, none of these kites is capable of flying with stability in winds ranging from very light to very strong.

SUMMARY OF THE INVENTION

Accordingly, it is an object of this invention to provide a kite which can be flown in winds ranging from very light to very strong.

It is another object of this invention to provide a keel kite made of sheet foam material which has great structural strength, provided in part, by a novel reenforcing member.

It is a further object of this invention to provide a kite made of sheet foam material which can be packaged flat for shipping and can be readily assembled.

These objects are accomplished by making the kite of two basic pieces: 1. an airfoil provided with hinged portions which are resiliently biassed closed, and which open, or retract, in response to wind. The degree of opening is in proportion to the strength of the wind. The position of the hinged portions in flight can vary from being substantially closed to substantially wide open. The closed position is defined as that in which the hinged portion is in the same plane as the other portion of the airfoil. 2. a keel which is inserted into two slots in the center line of the airfoil. Both the airfoil and keel are made of a sheet foam material such as polystyrene or polyurethane.

The keel and airfoil are held together by two rods which are inserted through slots at the outer ends of the airfoil and holes through the keel member. An additional hole is provided in the keel for insertion of the kite string.

Each of these holes is reinforced with a novel stiffener inserted into the polystyrene.

DESCRIPTION OF THE INVENTION

The retractable airfoil feature is illustrated and described in relation to a keel kite; however, this feature is not limited to use in keel kites.

Figure 1:
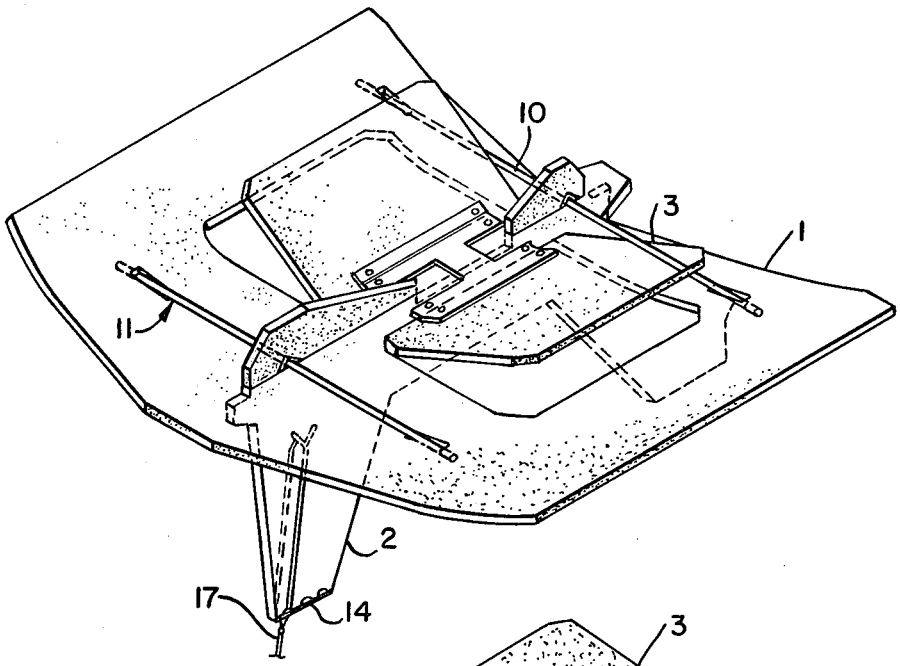
FIG. 1 is a perspective view of the preferred embodiment.
Figure 2:
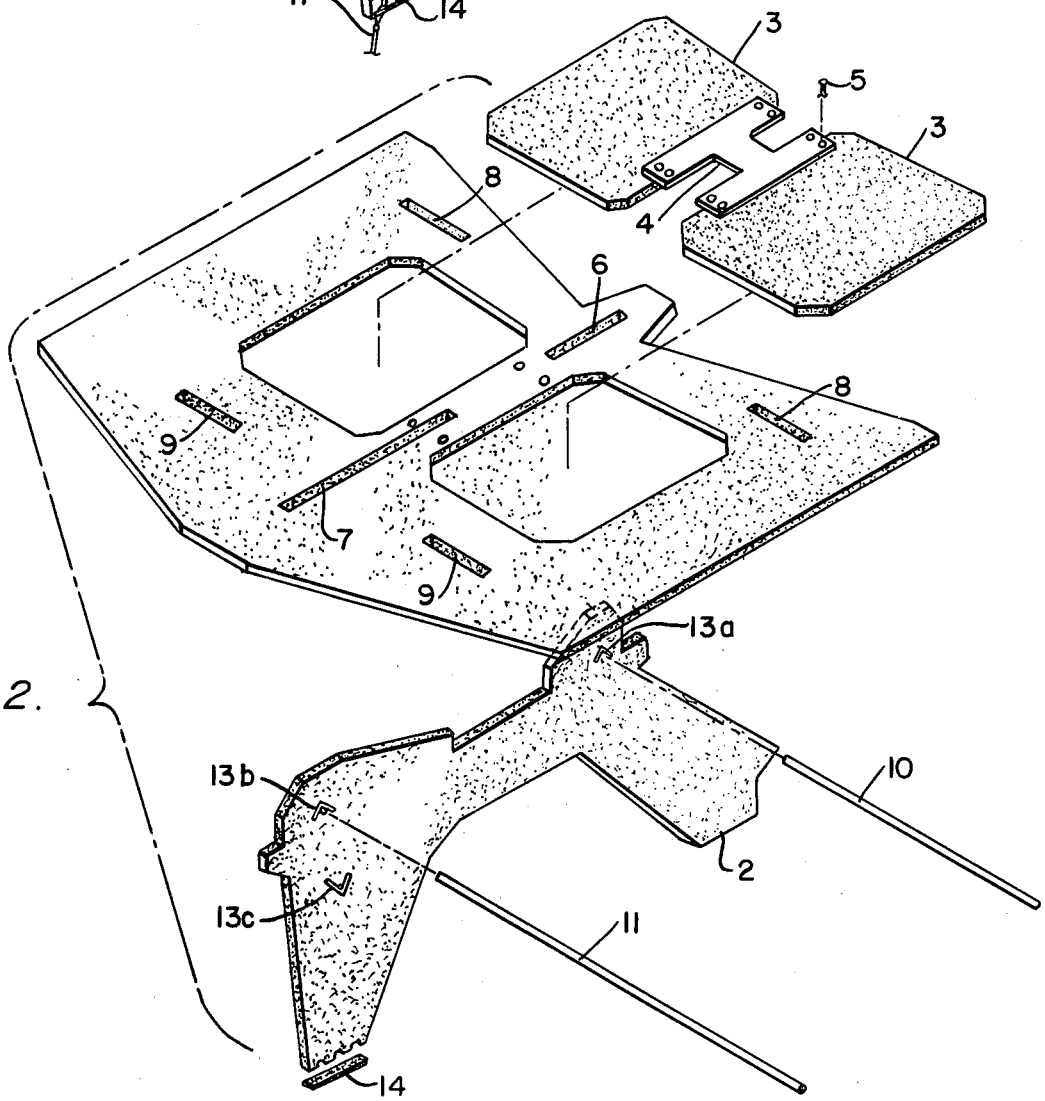
FIG. 2 is an exploded perspective of the assembly of FIG. 1.
Figure 3:
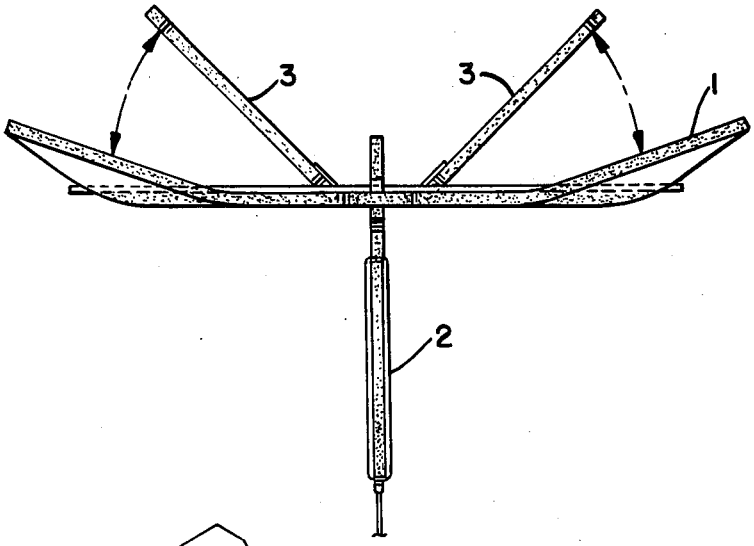
FIG. 3 is a front elevational view of FIG. 1 as it would appear in flight.

The kite, as shown in FIGS. 1, 2, and 3, is made of two main pieces: airfoil 1, and keel 2. Both 1 and 2 are made of sheet foam material such as polystyrene, or polyurethane. The airfoil has two vents formed by cutting out portions 3 which are then hinged together by hinge 4. The hinge is then connected to the main airfoil by any convenient means such as by plastic rivets 5. Hinge 4 must be made of a resilient material which will bend under stress and return to its original unbent position when the stress is removed. Polypropylene has been used successfully for this hinge. The kite is assembled by inserting the keel member 2 through slots 7. These slots have the same width as the width of the polystyrene sheet so that a snug fit is assured when the two pieces are interconnected.

Figure 6:
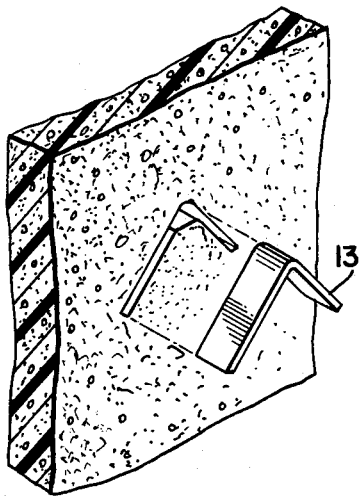
FIG. 6 is an exploded fragmentary perspective view of a reinforcement member and the foam member into which it is inserted.

The keel 2, as shown in FIG. 2 has three reenforcing members 13*a*, *b*, and *c*, each partially surrounding a small hole (unnumbered) in the keel. A reenforcing member is shown separately in FIG. 6. Reenforcing member 13 is made of a stiff material which can be formed into the shape shown and is stiff enough to retain its shape. A stiff plastic is used. The width of members 13 is equal to the thickness of the keel. The reenforcement pieces are inserted into the foam by simply using slight pressure. This is usually done before the kite is shipped to the user.

The assembled kite of FIG. 1 is flown in the same manner as any other kite and is held by string 17. In a light wind, the lift of the wind will press the tabs 3 to a slightly open position as shown in FIG. 1. As the wind increases, the tabs 3 open wider, proportional to the wind force, thus changing the amount of airfoil used for lift and providing a high degree of stability to the kite. Opening of the tabs proportionally to the wind force is caused by the inherent resiliency of each of the polypropylene hinge and the rubber band. This kite has been successfully flown in winds of 40 miles per hour.

The exact shape and dimensions of the kite pieces are not critical but the following design criteria have been used. Extension of the foam material of the keel to approximately 3 inches above the points 13*a* and 13*b* provides sufficient strength to avoid any rupture of the material. The vent tabs 3 can be of various shapes. The mitered corners are used to increase resistance to any fracture of the airfoil 1. In a model kite with a 36 inch wingspread, the distance from 13*c* to 14, on the keel, was 11 inches, and the area of the vent was approximately 35% of the total airfoil area. The choice of size, and to some degree, the shape was determined by the most efficient use of available sheet foam which comes in a standard width.

Figure 4:
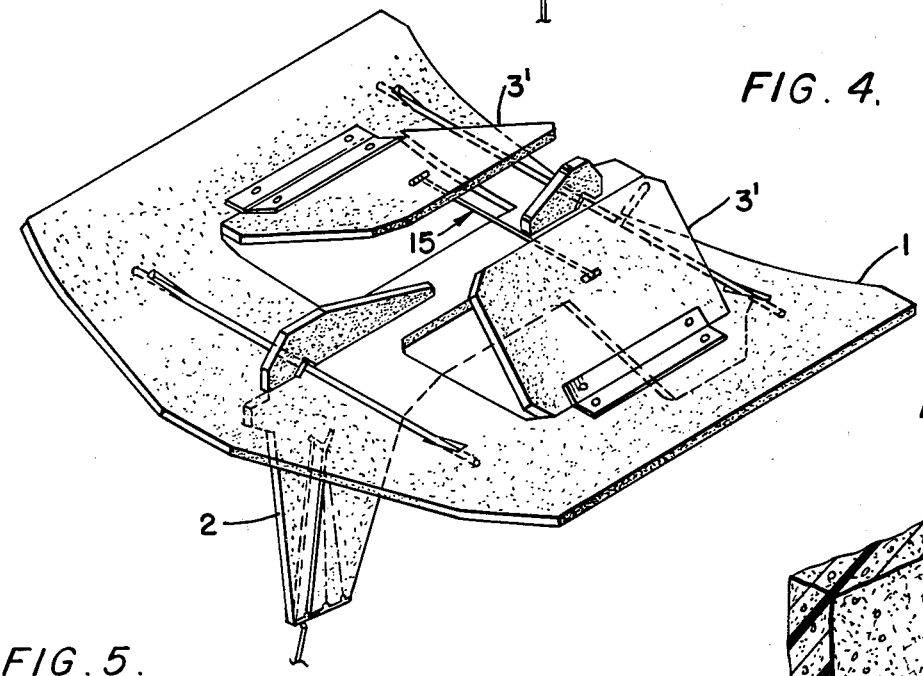
FIG. 4 is a perspective view of a modification.
Figure 5:
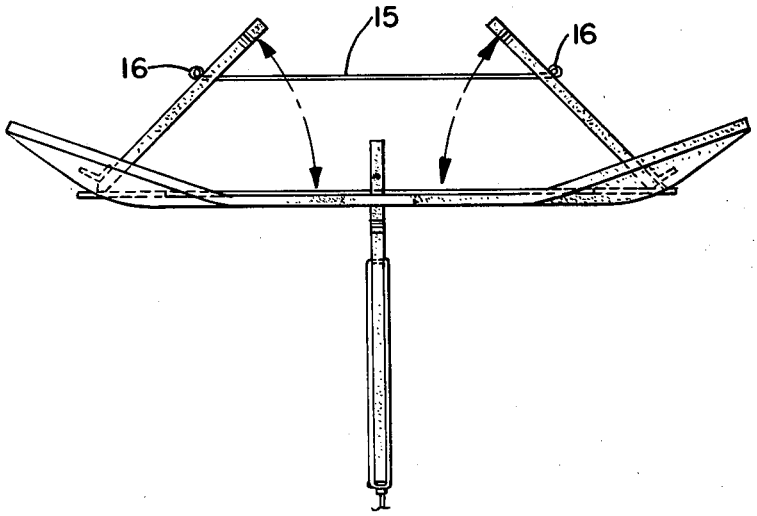
FIG. 5 is a front elevational view of the modification of FIG. 4 as it would appear in flight.

In the embodiment of FIGS. 4 and 5, the vent tabs are hinged at the outer edges of the airfoil, as shown in the drawing. They also have an additional resilient control 15. Member 15 is a stretchable material such as a rubber band. Each end of the band is wound around a short stiff plastic (or other material) rod and the rod is inserted through a hole in the vent tab, then oriented so that the short rod is parallel to the surface of the tab and the stretched rubber band holds the rods and the band itself in position. When the kite of this embodiment is flown, the wind exerts a force on the tabs and the rubber band 15 which acts to urge the tabs to the closed position. When the band 15 is used, the hinge could be made of either polypropylene as in the first embodiment of could be merely of plastic tape. If both the band and the polypropylene hinge are used, more wind force is required to open the vents than if only one resilient member is used.

Figure 7:
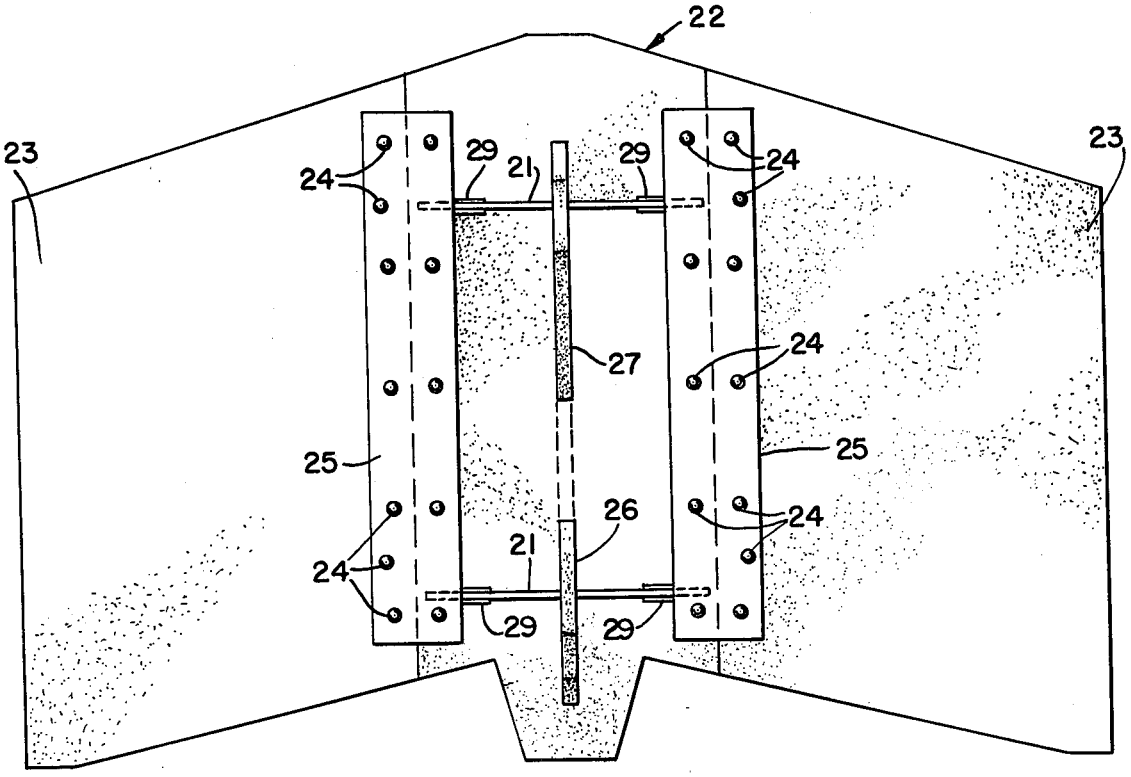
FIG. 7 is a top view of a wing of a further modification.
Figure 8:
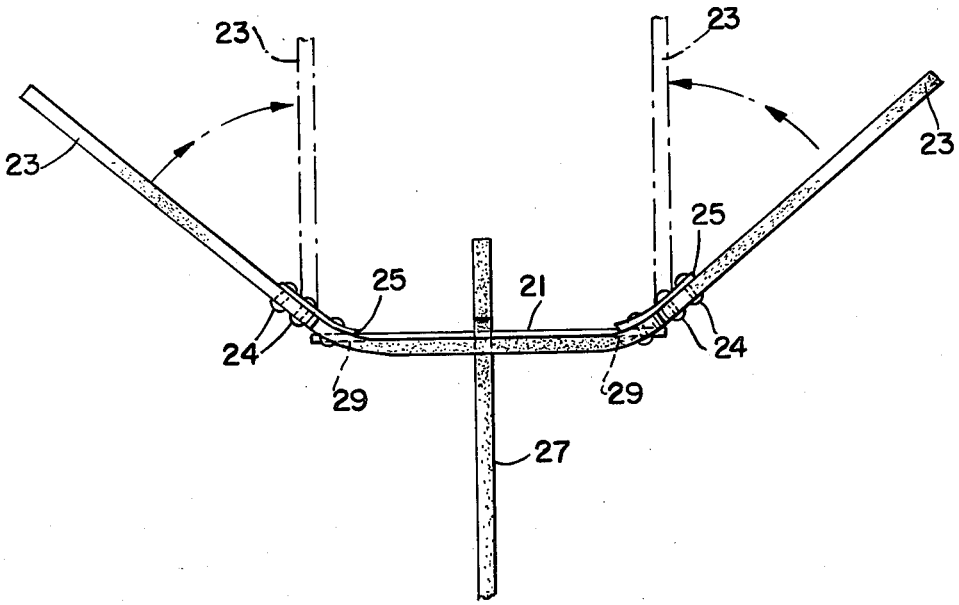
FIG. 8 is a front view of the kite with the wing of FIG. 7.

In the embodiment shown in FIGS. 7 and 8, the entire airfoil is hinged with both portions 23 bending with the action of the wind. The keel portion 27 is formed exactly the same as the keel 2 of the other embodiments and is inserted into portion 22 of the airfoil just as previously described. Slots 29 are provided in airfoil 22 for the insertion of rods 21 which hold the two pieces 22 and 27 together. In this embodiment, rods 21 are of the same length. Hinges 25 are attached to sections 22 and 23 by plastic rivets 24. As can be clearly shown in the drawing, the hinge line of each of the embodiments is parallel to the fore to aft centerline of the kite. This orientation of the hinge causes the tabs to act as rudders, thereby increasing the stability of the kite.

After the keel is snugly inserted into the airfoil, the assembly is completed by inserting rod 10 through one of the slots 8, then through a hole which is immediately under insert 13*a* and then inserting the end of rod 10 through the other slot 8 so that the rod rests on top of airfoil 1 with each of its ends contacting the lower surface of the airfoil as shown in FIG. 1. Rod 11 is inserted through slots 9 and hole adjacent insert 13*b* in a similar manner. These rods have the functions of holding the kite together and also creating dihedrals in airfoil 1 as shown in FIG. 3. The rods are made of wood or other stiff meterial. Since the rods are very stiff, the polystyrene bends to accomodate them. The dihedral angles formed by the rods improve the flying ability of the kite.

The kite string is attached through the hole just above 13*c*, and extends on both sides of the keel down to the end. It is tied together and a single string extends from 14 to the user of the kite. The three notches at the bottom of the keel provide three optional positions for the kite string and will vary the attitude of the kite. This can be adjusted by the user for the prevailing wind condition. Element 14 is a strip of plastic tape which is attached to the keel over the notches to protect the foam material from being cut by the string. The plastic tape has sufficient flexibility to permit the string to settle into one of the notched positions.

It can be seen from the drawing that inserts 13*a* and 13*b* receive the stress from the wind on the airfoil spreading it smoothly to the foam and preventing tearing, while 13*c* performs the same function relative to stress caused by the pull of the string 17.

The shape of the keel, the method of assembly, and the function of the reenforcing inserts are the same in all the embodiments.

What is claimed is:

1. A keel kite comprising:

a. an airfoil symmetrically shaped about a fore-and-aft centerline, said airfoil having a leading edge and a trailing edge, b. a keel firmly connected to said airfoil at said centerline, c. both said keel and said airfoil being made of substantially rigid material, d. said airfoil having a first portion which is firmly fixed in a position substantially perpendicular to the keel; and two additional portions, one on each side of the centerline;

e. wherein said first portion of said airfoil has an aperture on each side of the centerline, each said aperture having at least one linear edge, said additional portions comprising flaps generally conforming to the shape of the apertures, means for hinging the first portions and the additional portions together, said means for hinging being attached to the linear edges of the apertures and the flaps so that the flaps can substantially close the apertures;

f. wherein said linear edges of said apertures are farther from the centerline than any other edges of said apertures;

g. resilient means holding said additional portions in the same plane as said first portion in a static condition, and moving said additional portions to an angle with respect to said first portion in response to pressure from wind when the kite is being flown whereby the area of the airfoil surface which provides lift changes in proportion to the strength of the wind;

h. wherein said resilient means is an elongated flexible band having two ends, one end of said band being secured to an intermediate point on one of said flaps, and the other end of said band being secured to a correspondingly located intermediate point on the other of said flaps, said band being stressed to hold the flap closed in a static condition, and being stretched in response to wind pressure to open the flaps when the kite is being flown.

2. A keel kite comprising:

a. an airfoil symmetrically shaped about a fore-and-aft centerline, said airfoil having a leading edge and a trailing edge, b. a keel adapted to be firmly connected to said airfoil at said centerline, c. both said keel and said airfoil being made of substantially rigid sheet foam, d. said airfoil having first and second similar apertures, one aperture being on each side of the centerline, said apertures being symmetrically placed about the centerline, each of said aperatures having at least one linear edge, said apertures opening a significant portion of the airfoil surface, e. first and second flap members made from the same material as the airfoil, said flap members each having at least one linear edge and conforming in size and shape to the apertures, f. hinge members made of an elongated strip of resilient material attaching the linear edges of said flap members to the linear edges of said apertures so that the apertures are substantially closed when the hinges are in an unstressed condition, g. said hinge members being connected so that the flaps can move upwardly when the resilient hinges are stressed, h. wherein the hinge members are responsive solely to the wind when the kite is in flight, and the size of the aperture opening is dependent on the strength of the wind and is continuously variable in response to the wind, thereby providing stability and flyability at any velocity of wind as well as compensating for sudden gusts of wind.

* * * * *